US007909965B2

(12) United States Patent
Yazaki et al.

(10) Patent No.: US 7,909,965 B2
(45) Date of Patent: Mar. 22, 2011

(54) SHOE PRESS BELT

(75) Inventors: Takao Yazaki, Tokyo (JP); Nobuharu Suzuki, Tokyo (JP); Shintaro Yamazaki, Tokyo (JP); Atsushi Ishino, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 12/600,487

(22) PCT Filed: May 14, 2008

(86) PCT No.: PCT/JP2008/058884

§ 371 (c)(1),
(2), (4) Date: Dec. 30, 2009

(87) PCT Pub. No.: WO2008/143108

PCT Pub. Date: Nov. 27, 2008

(65) Prior Publication Data

US 2010/0147480 A1 Jun. 17, 2010

(30) Foreign Application Priority Data

May 18, 2007 (JP) ..... 2007-132288

(51) Int. Cl.
*D21F 3/02* (2006.01)

(52) U.S. Cl. ..... 162/358.4; 162/901

(58) Field of Classification Search ..... 162/306, 162/358.3, 358.4, 901; 442/64–67, 71; 528/59–66
See application file for complete search history.

(56) References Cited

U.S. PATENT DOCUMENTS

| | | | | |
|---|---|---|---|---|
| 2004/0029474 | A1 * | 2/2004 | Watanabe et al. | 442/181 |
| 2005/0197478 | A1 * | 9/2005 | Watanabe | 528/49 |
| 2005/0287373 | A1 | 12/2005 | Ishino et al. | |
| 2006/0118261 | A1 | 6/2006 | Ishino et al. | |
| 2007/0213157 | A1 * | 9/2007 | Noda | 474/237 |

FOREIGN PATENT DOCUMENTS

| | | | |
|---|---|---|---|
| JP | 5-43645 | * | 2/1993 |
| JP | 2002 146694 | | 5/2002 |
| JP | 2005 307421 | | 11/2005 |
| JP | 2006 37328 | | 2/2006 |
| JP | 2006 144139 | | 6/2006 |
| JP | 2007 119979 | | 5/2007 |

OTHER PUBLICATIONS

U.S. Appl. No. 12/666,301, filed Dec. 23, 2009, Yazaki, et al.
U.S. Appl. No. 12/718,218, filed Mar. 5, 2010, Yazaki, et al.

* cited by examiner

*Primary Examiner* — Eric Hug
(74) *Attorney, Agent, or Firm* — Oblon, Spivak, McClelland, Maier & Neustadt, L.L.P.

(57) ABSTRACT

Disclosed is a shoe press belt (10) which comprises a reinforcing fibrous base material (6) embedded in a polyurethane layer, and has an outer circumference layer (2*a*) and an inner circumference layer (2*b*) each formed with a polyurethane. The polyurethane layer constituting the outer circumference layer (2*a*) comprises a polyurethane which is cured by the reaction of an urethane prepolymer (A) with a curing agent mixture (B). The urethane prepolymer (A) is produced by reacting an isocyanate compound selected from p-phenylenediisocyanate and 4,4'-methylenebis(phenylisocyanate) with a polytetramethylene glycol and has an isocyanate group at its terminal. The curing agent mixture (B) comprises 1,4-butanediol and an aromatic polyamine having an active hydrogen group (H). The shoe press belt has excellent wear resistance, cracking resistance and bending fatigue resistance.

6 Claims, 9 Drawing Sheets

[Fig. 1]
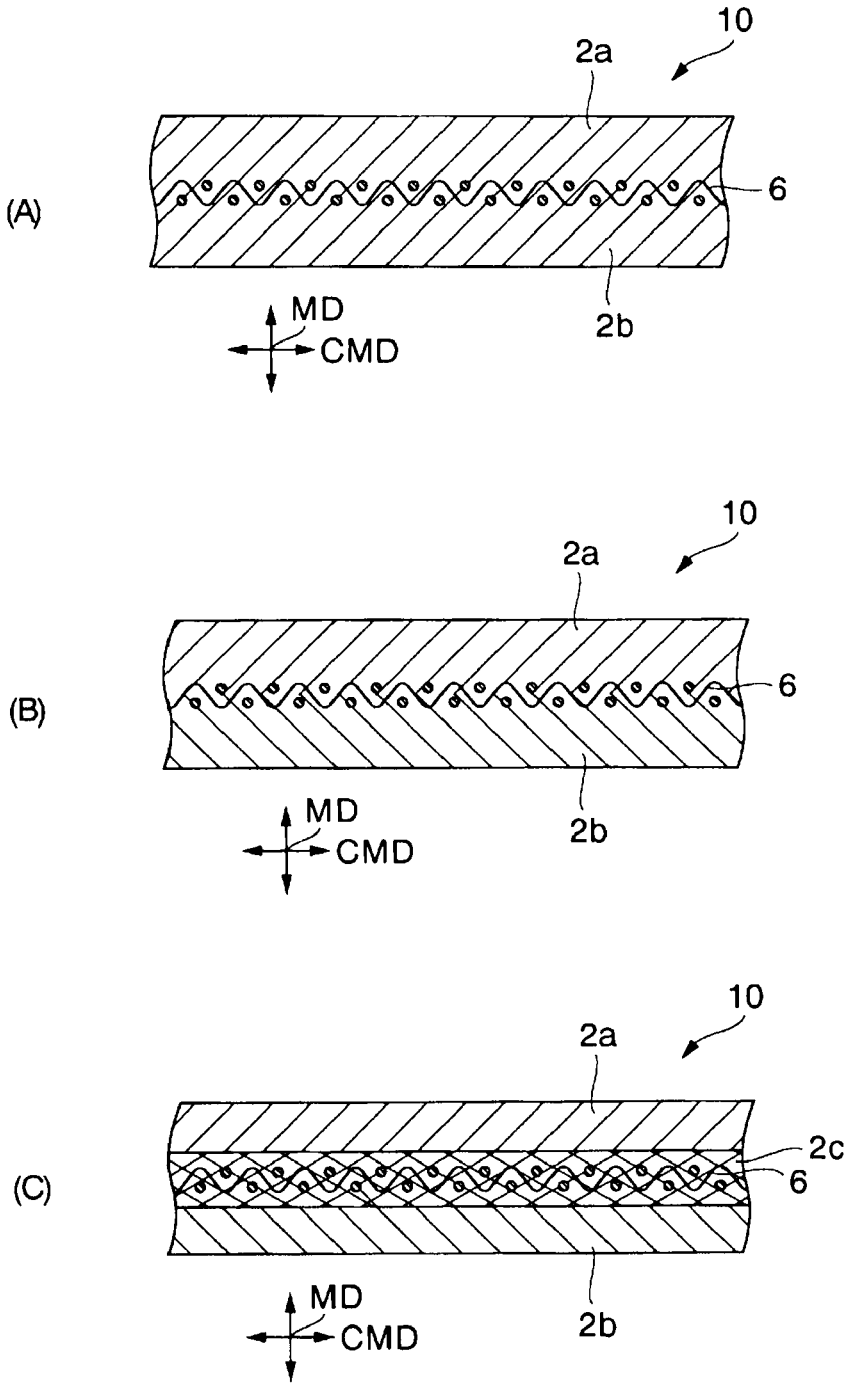

[Fig. 2]
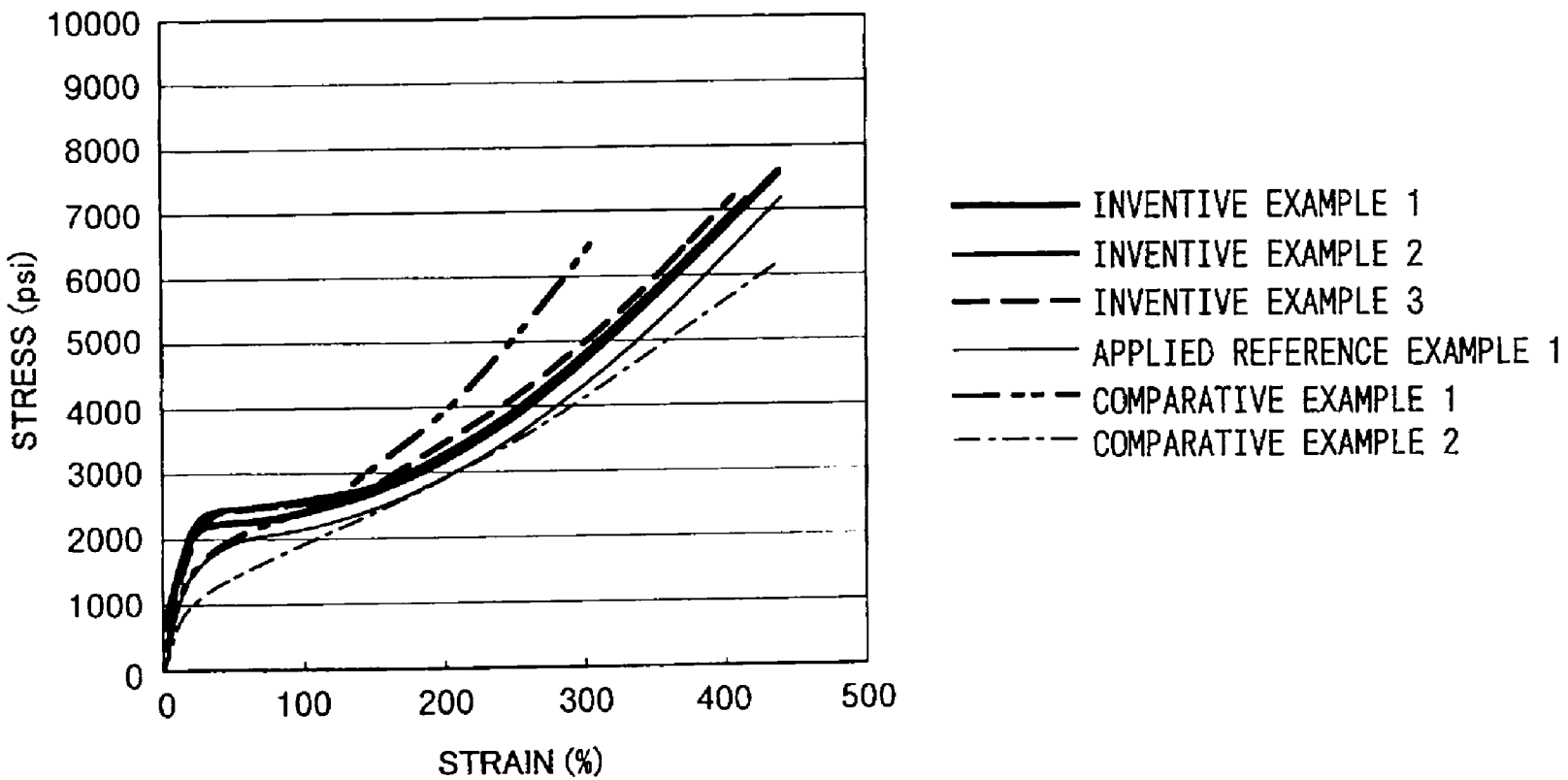

[Fig. 3]
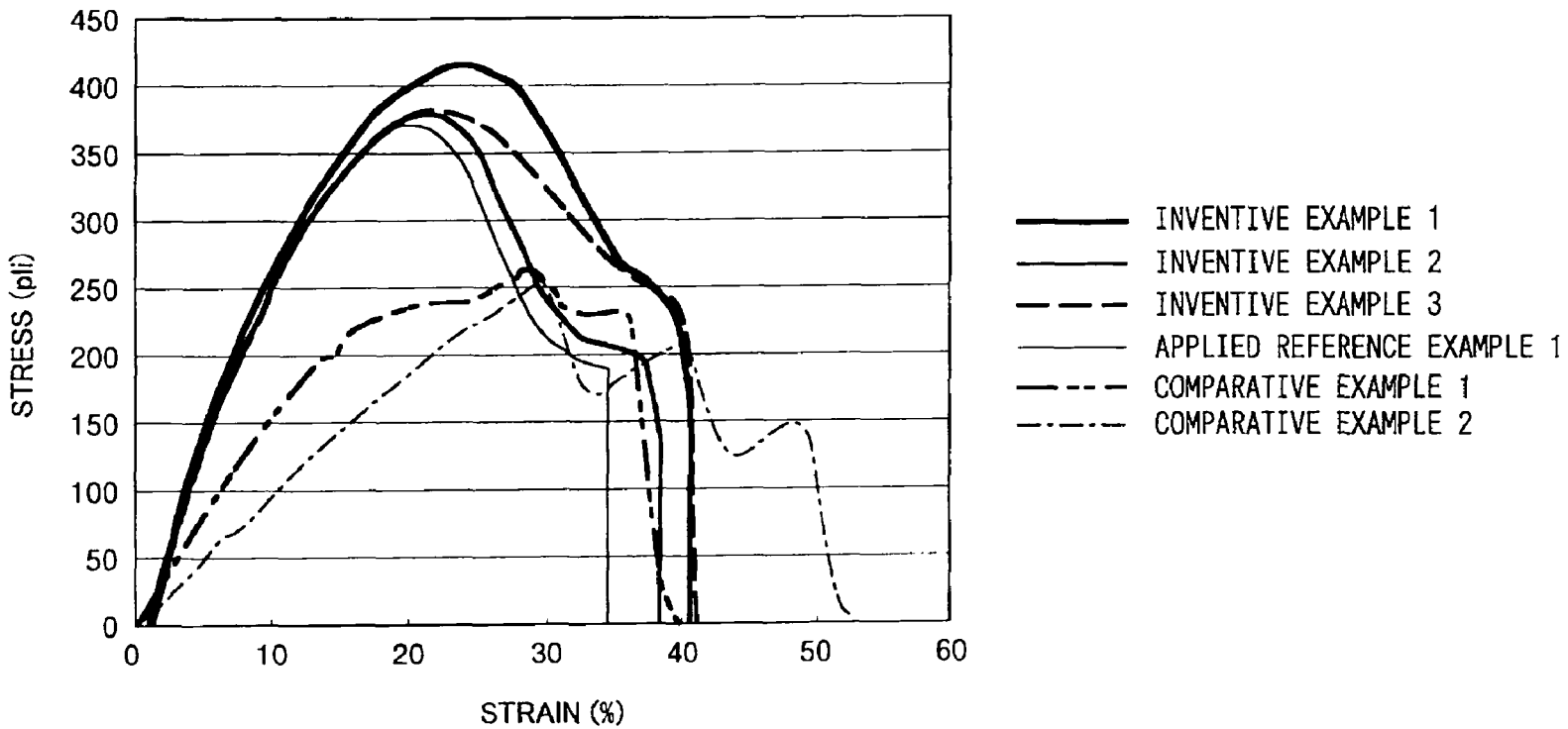

[Fig. 4]
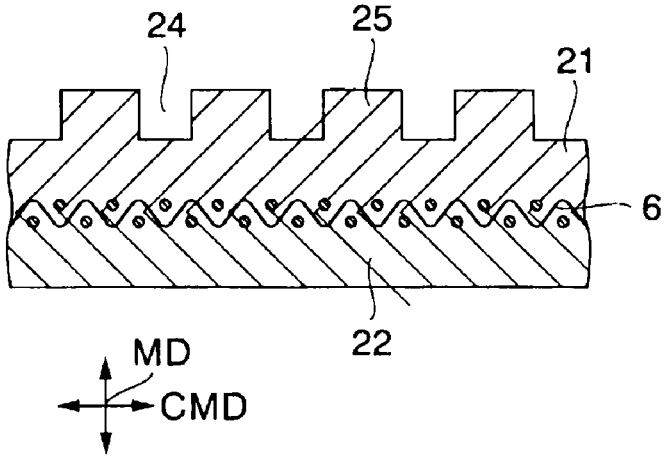
[Fig. 5]
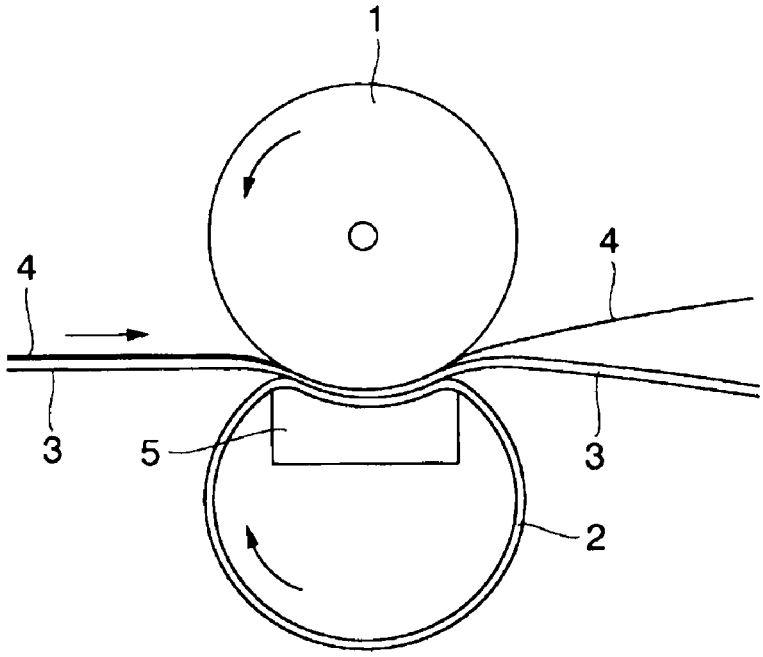

[Fig. 6]
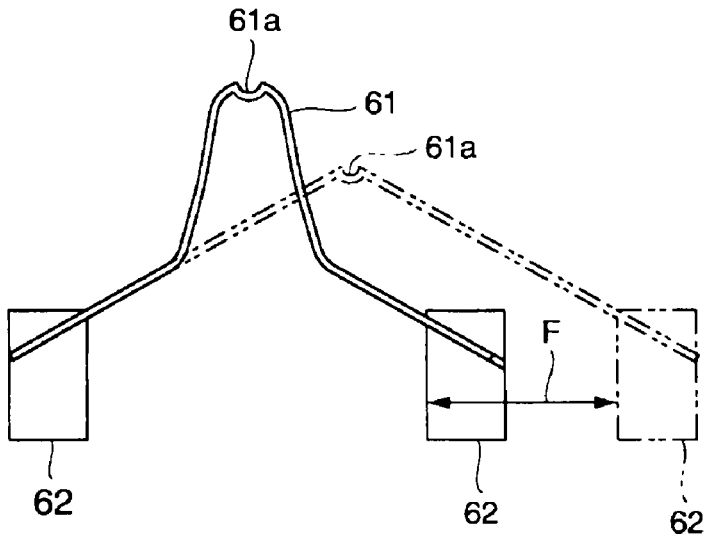
[Fig. 7]
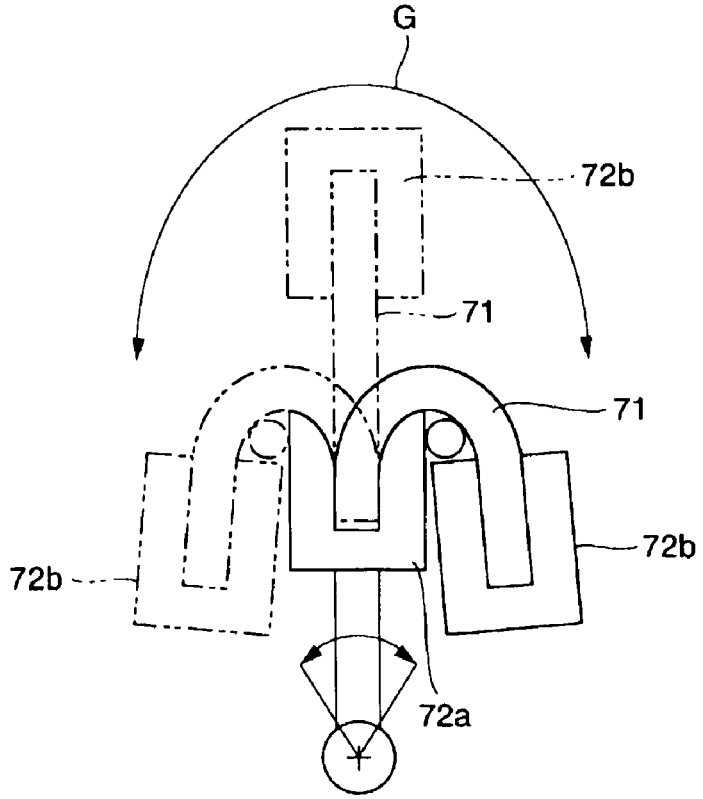

[Fig. 8]

| | REFERENCE EXAMPLE 1 | REFERENCE EXAMPLE 2 | REFERENCE EXAMPLE 3 | REFERENCE EXAMPLE 4 | REFERENCE EXAMPLE 5 | REFERENCE EXAMPLE 6 | REFERENCE EXAMPLE 7 | REFERENCE EXAMPLE 8 |
|---|---|---|---|---|---|---|---|---|
| URETHANE PREPOLYMER | INVENTIVE EXAMPLE 1 | INVENTIVE EXAMPLE 2 | INVENTIVE EXAMPLE 3 | APPLIED REFERENCE EXAMPLE 1 | COMPARATIVE EXAMPLE 1 | | | COMPARATIVE EXAMPLE 2 |
| ISOCYANATE | PPDI | PPDI | PPDI | PPDI | TDI | TDI | MDI | MDI |
| POLYOL | PTMG | PTMG | PTMG | PTMG | PTMG | PTMG | PTMG | PTMG |
| NCO (%) | 5.51 | 5.51 | 5.51 | 5.51 | 6.02 | 6.02 | 4.85 | 8.85 |
| VISCOSITY (cps) | 1800 (@55°C) | 1800 (@55°C) | 1800 (@55°C) | 1800 (@55°C) | 400 (@80°C) | 400 (@80°C) | 1000 (@70°C) | 400 (@100°C) |
| PREHEATING TEMPERATURE (°C) | 66 | 66 | 66 | 66 | 66 | 66 | 66 | 80 |
| CURING AGENT (COMPOUND NAME) | 1,4-BD | 1,4-BD | 1,4-BD | 1,4-BD | ETHACURE 300 | MOCA | ETHACURE 300 | 1,4-BD |
| EQUIVALENT RATIO | 45.06 | 45.06 | 45.06 | 45.06 | 107.15 | 133.6 | 107.15 | 45.06 |
| ACTIVE HYDROGEN (MOLAR %) | 97 | 95 | 90 | 100 | 100 | 100 | 100 | 100 |
| PREHEATING TEMPERATURE (°C) | 24 | 24 | 24 | 24 | 24 | 116 | 24 | 24 |
| CURING AGENT (COMPOUND NAME) | ETHACURE 100 | ETHACURE 300 | ETHACURE 300 | | | | | |
| ACTIVE HYDROGEN (MOLAR %) | 3 | 5 | 10 | | | | | |
| EQUIVALENT RATIO | 89.14 | 107.15 | 107.15 | | | | | |
| PREHEATING TEMPERATURE (°C) | 24 | 24 | 24 | | | | | |

[Fig. 9]

| | | REFERENCE EXAMPLE 1 | REFERENCE EXAMPLE 2 | REFERENCE EXAMPLE 3 | REFERENCE EXAMPLE 4 | REFERENCE EXAMPLE 5 | REFERENCE EXAMPLE 6 | REFERENCE EXAMPLE 7 | REFERENCE EXAMPLE 8 |
|---|---|---|---|---|---|---|---|---|---|
| EQUIVALENT RATIO OF CURING AGENT | | 46.38 | 48.16 | 51.27 | 45.06 | 107.15 | 133.6 | 107.15 | 45.06 |
| COMPOSITION (H/NCO RATIO) | | 0.95 | 0.95 | 0.95 | 0.95 | 0.95 | 0.95 | 1.05 | 0.95 |
| CURING AGENT COMPOUNDED AMOUNT (PARTS) | | 5.8 | 6.0 | 6.4 | 5.6 | 14.6 | 18.2 | 13.0 | 9.0 |
| PRECURING CONDITIONS (°C/Hr) | | 127/0.5 | 127/0.5 | 127/0.5 | 127/0.5 | 100/0.5 | 100/0.5 | 100/1 | 115/1 |
| POSTCURING CONDITIONS (°C/Hr) | | 127/16 | 127/16 | 127/16 | 127/16 | 100/16 | 100/16 | 100/14 | 115/16 |
| POLYURETHANE PROPERTIES | JIS A HARDNESS | 98.1 | 98.2 | 98.2 | 98.1 | 96.2 | 96.0 | 93.2 | 95.2 |
| | 100% MODULUS (psi) | 2390 | 2330 | 2520 | 2120 | 2430 | 1890 | 1850 | 1840 |
| | 300% MODULUS (psi) | 4680 | 4725 | 4900 | 4300 | 6330 | 5020 | 4780 | 4080 |
| | BREAKING STRENGTH (psi) | 7075 | 7630 | 7280 | 7200 | 6505 | 7540 | 6630 | 6185 |
| | BREAKING ELONGATION (%) | 415 | 440 | 410 | 440 | 305 | 360 | 400 | 440 |
| | TEAR RESISTANCE (pli) | 420 | 380 | 380 | 370 | 260 | 220 | 250 | 250 |
| | DEPTH OF WEAR (mm) | 0.039 | 0.051 | 0.063 | 0.101 | 0.140 | 0.135 | 0.574 | 0.988 |
| | DE MATTIA (μm/COUNT) | 1.04 | 1.09 | 2.80 | 0.55 | 6.09 | 8.10 | 0.60 | 0.08 |

[Fig. 10]

| TIME | STROKE COUNT | INVENTIVE EXAMPLE 1 | INVENTIVE EXAMPLE 2 | INVENTIVE EXAMPLE 3 | APPLIED REFERENCE EXAMPLE 1 | COMPARATIVE EXAMPLE 1 | COMPARATIVE EXAMPLE 2 |
|---|---|---|---|---|---|---|---|
| 0.0 | 0 | 2.21 | 1.84 | 1.94 | 2.12 | 2.08 | 2.07 |
| 0.5 | 180 | 3.69 | 3.42 | 3.68 | 3.39 | 3.81 | 2.41 |
| 1.0 | 359 | | | 4.77 | | | 2.64 |
| 1.5 | 539 | 4.60 | | | 3.97 | 5.79 | |
| 2.0 | 718 | | 4.46 | | | | 2.84 |
| 3.0 | 1077 | | | 6.34 | 4.51 | 8.71 | |
| 4.5 | 1616 | 5.64 | | | | | |
| 5.0 | 1795 | | 5.58 | | | 12.90 | 3.12 |
| 6.0 | 2154 | | | 7.55 | 5.15 | | |
| 7.0 | 2513 | | | | | 19.28 | |
| 9.5 | 3411 | 7.18 | | | | | |
| 10.0 | 3590 | | 7.30 | 10.63 | | | 3.49 |
| 11.0 | 3949 | | | | 6.10 | | |
| 12.0 | 4308 | | | 13.26 | | | |
| 14.5 | 5206 | 8.75 | | | | | |
| 15.0 | 5385 | | | 18.42 | | | |
| 17.0 | 6103 | | 9.36 | | | | |
| 17.8 | 6372 | 9.54 | | | | | |
| 20.0 | 7180 | 10.19 | 10.45 | | | | 3.83 |
| 22.0 | 7898 | | | | 7.77 | | |
| 25.0 | 8975 | 11.95 | 11.89 | | | | |
| 27.0 | 9693 | | | | 8.53 | | |
| 32.0 | 11488 | | | | 9.23 | | |
| 35.0 | 12565 | 15.70 | 15.54 | | | | |
| 37.0 | 13283 | | | | 10.01 | | |
| 40.0 | 14360 | | | | | | 4.48 |
| 51.0 | 18309 | | | | 12.22 | | |
| 69.5 | 24951 | | | | 17.65 | | |
| 70.0 | 25130 | | | | | | 5.30 |
| 300.0 | 107700 | | | | | | 10.33 |
| 420.0 | 150780 | | | | | | 14.09 |
| 480.0 | 172320 | | | | | | 16.56 |
| STROKE COUNT AT 15 mm | | 12280 | 12127 | 4658 | 23612 | 2123 | 165200 |

[Fig. 11]

| | INVENTIVE EXAMPLE | | | APPLIED REFERENCE EXAMPLE | COMPARATIVE EXAMPLE | |
|---|---|---|---|---|---|---|
| | 1 | 2 | 3 | 1 | 1 | 2 |
| DEPTH OF WEAR (mm) | 0.076 | 0.105 | 0.137 | 0.213 | 0.269 | 2.230 |
| FLEXING COUNT (TEN THOUSANDS) | 70 (NOT BROKEN) | 70 (NOT BROKEN) | 70 (NOT BROKEN) | 70 (NOT BROKEN) | 20 | 70 (NOT BROKEN) |

SHOE PRESS BELT

FIELD OF THE INVENTION

The present invention relates to a belt for use in a papermaking shoe press, and more particularly to a belt for use in a closed-type shoe press. More specifically, the present invention is concerned with a shoe press belt which has a resin layer of polyurethane having a certain composition and which has excellent mechanical properties in wear resistance, crack resistance, flexural fatigue resistance, etc.

DESCRIPTION OF THE RELATED ART

FIG. 4 is a cross-sectional view of the shoe press belt, and FIG. 5 is a cross-sectional view of a wet paper web dehydrator.

As shown in FIG. 5, a shoe press mechanism for use in a shoe press process comprises a looped shoe press belt 2 interposed between a press roll 1 and a shoe 5. The press roll 1 and the shoe 5 provide a pressing region therebetween through which a feed felt 3 and a wet paper web 4 are caused to pass to dehydrate the wet paper web 4.

As shown in FIG. 4, the shoe press belt 2 comprises an outer circumferential polyurethane layer 21 and an inner circumferential polyurethane layer 22 which are disposed respectively on both surfaces of a fiber base 6 which is sealed (embedded) in the polyurethane layers.

The outer circumferential polyurethane layer 21 that is held against the press roll has a number of concave grooves 24 defined in its surface. Water, which is squeezed from the wet paper web 4 when it is pressed in the pressing region, is held in the concave grooves 24, and then brought out of the pressing region as the shoe press belt rotates.

Ridges 25 formed on the outer circumferential polyurethane layer 21, which is held against the press roll, are required to have their mechanical properties improved. The mechanical properties include wear resistance, crack resistance, flexural fatigue resistance, etc. against vertical pressing forces applied by the press roll 1 and wear and flexural fatigue of the shoe press belt in the pressing region.

For the above reasons, polyurethane having an excellent crack resistance is widely used as the resin material of the outer circumferential polyurethane layer 21 of the shoe press belt 2.

Belts for papermaking belts, for example, comprise an integral structure of a reinforcing fiber base and a polyurethane layer, and the polyurethane layer comprises an outer circumferential layer and an inner circumferential layer. The reinforcing fiber base is embedded in the polyurethane layer.

JP, A, 2002-146694 and JP, A, 2005-120571 disclose papermaking belts made of polyurethane.

The outer circumferential layers of these papermaking belts are made of polyurethane having a "JIS A hardness" ranging from 89 to 94. The polyurethane comprises a mixture of a urethane prepolymer (HIPRENE L: trade name, manufactured by Mitsui Chemicals, Inc.) and a curing agent containing dimethylthiotoluene diamine. The equivalent ratio (H/NCO) of an active hydrogen group (H) of the curing agent and an isocyanate group (NCO) of the urethane prepolymer has a value in the range of $1<H/NCO<1.15$.

The composition made up of the mixture of the urethane prepolymer and the curing agent is cured into the polyurethane. The urethane prepolymer is produced by reacting toluene-2,6-diisocyanate (TDI) and polytetramethylene glycol (PTMG), and has a terminal isocyanate group.

The inner circumferential layers of the papermaking belts are made of polyurethane comprising a mixture of a urethane prepolymer and a mixed curing agent. The urethane prepolymer and the mixed curing agent are mixed such that the equivalent ratio (H/NCO) of an active hydrogen group (H) of the curing agent and an isocyanate group (NCO) of the urethane prepolymer has a value in the range of $0.85 \leqq H/NCO<1$.

The urethane prepolymer is produced by reacting 4,4'-methylene-bis(phenyl isocyanate) {MDI} and polytetramethylene glycol (PTMG), and has a terminal isocyanate group.

The mixed curing agent contains 65 parts of dimethylthiotoluene diamine and 35 parts of polytetramethylene glycol (PTMG). The composition made up of the mixture of the urethane prepolymer and the curing agent is cured into the polyurethane. The shoe press belt is formed of these polyurethanes.

A papermaking shoe press belt also disclosed in JP, A, 2005-307421 comprises an integral structure of a reinforcing fiber base and a polyurethane layer. The polyurethane layer of the belt comprises an outer circumferential layer and an inner circumferential layer. The reinforcing fiber base is embedded in the polyurethane layer.

The polyurethane of the belt comprises a mixture of a urethane prepolymer (HIPRENE L: trade name, manufactured by Mitsui Chemicals, Inc.) and a curing agent containing dimethylthiotoluene diamine, such that the equivalent ratio (H/NCO) of an active hydrogen group (H) of the curing agent and an isocyanate group (NCO) of the urethane prepolymer has a value of 0.97.

The urethane prepolymer is produced by reacting tolylene-diisocyanate (TDI) with polytetramethylene glycol (PTMG), and has a terminal isocyanate group.

The composition made up of the mixture of the urethane prepolymer and the curing agent is cured into the polyurethane which has a "JIS A hardness" ranging from 94 to 95.

A shoe press belt disclosed in Japanese JP, A, 2006-144139 comprises an integral structure of a reinforcing fiber base and a polyurethane layer. The reinforcing fiber base is embedded in the polyurethane layer.

The polyurethane of the shoe press belt is made of a urethane prepolymer and a curing agent which are mixed such that the equivalent ratio (H/NCO) is in the range of $0.9 \leqq H/NCO \leqq 1.10$.

The urethane prepolymer contains unreactive polydimethylsiloxane in a liquid form. The urethane prepolymer is produced by reacting tolylene diisocyanate (TDI) and polytetramethylene glycol (PTMG), and has a terminal isocyanate group.

The curing agent is selected from dimethylthiotoluene diamine (ETHACURE300) or 4,4'-methylene-bis(2-chloroaniline) {MOCA}.

The composition made up of the mixture of the urethane prepolymer and the curing agent is cured into the polyurethane which has a "JIS A hardness" ranging from 93 to 96.

JP, A, 2006-144139 also proposes another shoe press belt. The belt is made of polyurethane which is a mixture of polyurethane, having a "JIS A hardness" ranging from 90 to 93 and containing unreactive polydimethylsiloxane in a liquid form, and polyurethane having a "JIS A hardness" of 98 and free of unreactive polydimethylsiloxane in a liquid form. The mixture is mixed with a curing agent of dimethylthiotoluene diamine at an equivalent ratio in the range of $0.9 \leqq H/NCO \leqq 1.10$.

The composition made up of the mixture of the urethane prepolymer and the curing agent is cured so that the shoe press belt which has a "JIS A hardness" ranging from 90 to 93 is formed.

Patent Document 1: JP, A, 2002-146694

Patent Document 2: JP, A, 2005-120571

Patent Document 3: JP, A, 2005-307421

Patent Document 4: JP, A, 2006-144139

The embodiments of JP, A, 2002-146694, JP, A, 2005-120571, JP, A, 2005-307421, and JP, A, 2006-144139 disclose shoe press belts.

The shoe press belts are measured by an inspecting apparatus. For measurement, the opposite ends of a test piece of a belt are gripped by clamp hands. The cramp hands are reciprocally movable horizontally in a ganged fashion. The test piece has an evaluation surface facing a rotating roll, and the press shoe moves toward the rotating roll to press the test piece for measuring crack resistance thereof.

While the test piece was subjected to a tensile force of 3 kg/cm and a pressure of 36 kg/cm$^2$ by the inspecting apparatus, the clamp hands were reciprocally moved at a speed of 40 cm/sec., and the number of times that the clamp hands were reciprocally moved was measured until the test piece is cracked. As a result, it was found that no crack developed in the test piece after the clamp hands were reciprocally moved 1,000,000 times.

In recent years, the shoe press belts have been used in highly severe environments as the operating speed has increased to meet demands for higher paper productivity growth, the shoe press belts have had an increased width of about 10 m, and the pressure applied in the pressing region has become higher. Therefore, the various properties of the shoe press belts need to be improved further.

The present invention has been made to solve the above problems. It is an object of the present invention to provide a shoe press belt which has excellent mechanical properties in wear resistance, crack resistance, flexural fatigue resistance, etc.

DISCLOSURE OF THE INVENTION

To achieve the above object, a shoe press belt for paper making according to claim 1 comprises a reinforcing fiber base and a polyurethane layer which are integral with each other, and the reinforcing fiber base is embedded in the polyurethane layer.

The polyurethane layer includes a polyurethane produced by curing a composition mixing combining urethane prepolymer (A) an active hydrogen group (H) containing curing agent (B).

The urethane prepolymer (A) is obtained by reacting an isocyanate compound (a) with polytetramethylene glycol (b), and has a terminal isocyanate group.

The isocyanate compound (a) comprises 55 to 100 molar % of an isocyanate compound selected from a p-phenylene diisocyanate compound and 4,4'-methylene-bis(phenyl isocyanate).

The curing agent (B) comprises a curing agent containing 85 to 99.9 molar % of 1,4-butanediol and 15 to 0.1 molar % of active hydrogen group (H) containing aromatic polyamine.

Preferably, the active hydrogen group (H) containing aromatic polyamine comprises a mixture of one or more aromatic polyamines selected from 3,5-diethyltoluene-2,4-diamine, 3,5-diethyltoluene-2,6-diamine, 3,5-dimethylthiotoluene-2,4-diamine, 3,5-dimethylthiotoluene-2,6-diamine, 4,4'-bis(2-chloroaniline), 4,4'-bis(sec-butylamino)-diphenylmethane, N,N'-dialkyldiaminodiphenyl-methane, 4,4'-methylenedianiline, 4,4'-methylene-bis(2,3-dichloroaniline), 4,4'-methylene-bis(2-chloroaniline), 4,4'-methylene-bis(2-ethyl-6-methylaniline), trimethylene-bis(4-aminobenzoate), and phenylenediamine.

Preferably, a shoe press belt for papermaking according to the present invention comprises a reinforcing fiber base and a polyurethane layer which are integral with each other, and the reinforcing fiber base is embedded in the polyurethane layer. The polyurethane layer comprises an outer circumferential polyurethane layer and an inner circumferential polyurethane layer.

In the belt, the outer circumferential polyurethane layer is formed of the polyurethane according to claim 1.

The reinforcing fiber base is embedded in the inner circumferential polyurethane layer. The inner circumferential polyurethane layer is made, in a first case, of a polyurethane obtained by curing a composition containing urethane prepolymer having a terminal isocyanate group obtained by reacting 4,4'-methylene-bis(phenyl isocyanate) and polytetramethylene glycol with a curing agent selected from 3,5-dimethylthiotoluenediamine, 3,5-diethyltoluenediamine and 1,4-butanediol.

The inner circumferential polyurethane layer is made, in a second case, of a polyurethane obtained by curing a composition containing urethane prepolymer having a terminal isocyanate group obtained by reacting an isocyanate compound (a) selected from 2,4-tolylene diisocyanate and 2,6-tolylene diisocyanate with polytetramethylene glycol (b), with aromatic polyamine selected from 3,5-dimethylthiotoluenediamine and 3,5-diethyltoluenediamine.

Preferably, a shoe press belt for papermaking according to the present invention comprises a reinforcing fiber base and a polyurethane layer which are integral with each other, the polyurethane layer comprising an outer circumferential polyurethane layer, an intermediate polyurethane layer with the reinforcing fiber base embedded therein, and an inner circumferential polyurethane layer. The outer circumferential polyurethane layer and the inner circumferential polyurethane layer are disposed on respective both sides of the intermediate polyurethane layer.

In the belt, the outer circumferential polyurethane layer and the inner circumferential polyurethane layer are made of the polyurethane according to claim 1.

The intermediate polyurethane layer is made of a polyurethane produced by curing a composition containing urethane prepolymer obtained by reacting an isocyanate compound selected from 2,4-tolylene diisocyanate, 2,6-tolylene diisocyanate and 4,4'-methylene-bis(phenyl isocyanate) with polytetramethylene glycol (b), with a curing agent selected from 3,5-dimethylthiotoluenediamine and 3,5-diethyltoluenediamine.

Preferably, a shoe press belt for papermaking according to the present invention comprises a reinforcing fiber base and a polyurethane layer which are integral with each other, and the polyurethane layer comprises an outer circumferential polyurethane layer with the reinforcing fiber base embedded therein, and an inner circumferential polyurethane layer.

In the belt, the outer circumferential polyurethane layer is made of the polyurethane according to claim 1.

The inner circumferential polyurethane layer is made of a polyurethane obtained by curing a composition containing urethane prepolymer with aromatic polyamine selected from 3,5-dimethylthiotoluenediamine and 3,5-diethyltoluenediamine.

The urethane prepolymer is produced by reacting an isocyanate compound selected from 2,4-tolylene diisocyanate, 2,6-tolylene diisocyanate and 4,4'-methylene-bis(phenyl isocyanate) with polytetramethylene glycol, and has a terminal isocyanate group.

Preferably, a shoe press belt for papermaking according to the present invention comprises a reinforcing fiber base and a polyurethane layer which are integral with each other, and the polyurethane layer comprises an outer circumferential polyurethane layer, an intermediate polyurethane layer, with the reinforcing fiber base embedded therein, and an inner circumferential polyurethane layer.

All of the outer circumferential polyurethane layer, the intermediate polyurethane layer and the inner circumferential polyurethane layer are made of the polyurethane according to claim 1.

With the present invention being thus arranged, p-phenylene diisocyanate (PPDI) for easily forming linear polymers and polytetramethylene glycol can be used as materials of the urethane prepolymer (A) of the outer circumferential polyurethane layer of the shoe press belt facing a wet paper web.

Aliphatic 1,4-butanediol for easily forming linear polymers can be used as a primary component of the curing agent (B) having the active hydrogen group (H), and an aromatic polyamine compound can be used as a subsidiary component in combination therewith.

Since the urethane prepolymer made of p-phenylene diisocyanate absorbs water in the atmosphere, the wear resistance of the polyurethane is not lowered.

Since the polyurethane has much greater wear resistance than polyurethane produced from 1,4-butanediol alone, the shoe press belt has excellent mechanical properties in wear resistance, crack resistance, and flexural fatigue resistance though its hardness is high.

In particular, the aromatic polyamine compound used as a subsidiary component in combination with the aliphatic 1,4-butanediol as a curing agent is effective to increase the wear resistance without reducing the "JIS A hardness" of the produced polyurethane. Therefore, the durability of the shoe press belt according to the present invention is expected to be at least twice the durability (usually 2 to 3 months) of shoe press belts currently in use.

With the shoe press belt according to claim 4, the polyurethane of the inner and outer circumferential layers is hard polyurethane having a "JIS A hardness" ranging from 92 to 100 for increased wear resistance, and the intermediate layer is made of polyurethane having an excellent ductility for enforce flexural resistance. The durability of the shoe press belt is thus further increased.

The shoe press belt according to claims 5 and 6 is much higher in durability than shoe press belts of the related art, and provides the same advantages as described above.

BRIEF DESCRIPTION OF THE DRAWINGS

FIG. 1 cross-sectional views of shoe press belts.

FIG. 2 a graph showing stress vs. strain curves of various polyurethanes.

FIG. 3 a diagram showing a correlation between stresses and strains with respect to tear resistance for notched angles made of various polyurethanes.

FIG. 4 a cross-sectional view of a shoe press belt.

FIG. 5 a cross-sectional view of a wet paper web dehydrator.

FIG. 6 a view illustrative of similar to De Mattia flexing test.

FIG. 7 a view illustrative of a flexural fatigue test.

FIG. 8 a table showing experimental data.

FIG. 9 a table showing experimental data.

FIG. 10 a table showing experimental data.

FIG. 11 a table showing experimental data.

BEST MODE FOR CARRYING OUT THE INVENTION

Embodiments of the present invention will be described in detail below with reference to the drawings.

FIG. 1 is cross-sectional views of shoe press belts according to the present invention. Each of the belts comprises an integral structure of a reinforcing fiber base and a polyurethane layer, and the reinforcing fiber base is embedded in the polyurethane layer.

A shoe press belt 10 shown in FIG. 1(A) is a single polyurethane layer. A shoe press belt 10 shown in FIG. 1(B) is a polyurethane layer of two-layer structure comprising an outer circumferential layer 2*a* and an inner circumferential layer 2*b*. A shoe press belt 10 shown in FIG. 1(C) is a polyurethane layer of three-layer structure comprising an outer circumferential layer 2*a*, an intermediate layer 2*c* and an inner circumferential layer 2*b*.

Either one of the shoe press belts 10 shown in FIGS. 1(A) through 1(C) has the outer circumferential polyurethane layer 2*a* for facing a wet paper web. The outer circumferential polyurethane layer 2*a* should preferably contain polyurethane produced when a composition comprising a mixture of a urethane prepolymer (A) and a curing agent (B) is cured by being heated at 70 to 140° C. for 2 to 20 hours.

The urethane prepolymer and the curing agent (B) are mixed such that the equivalent ratio (H/NCO) of an active hydrogen group (H) of the curing agent (B) and an isocyanate group (NCO) of the urethane prepolymer (A) has a value in the range of $0.88 \leqq H/NCO \leqq 1.12$.

The urethane prepolymer (A) is produced by reacting with an isocyanate compound (a), containing 55 to 100 molar % of an isocyanate selected from p-phenylene diisocyanate and 4,4'-methylene-bis(phenyl isocyanate), and polytetramethylene glycol (b), and has a terminal isocyanate group.

The curing agent (B) contains 85 to 99.9 molar % of 1,4-butanediol and 15 to 0.1 molar % of aromatic polyamine having an active hydrogen group (H).

A reinforcing fiber base 6 may comprise a woven fabric disclosed in JP, A, 2002-146694, JP, A, 2005-120571, JP, A, 2005-307421 and JP, A, 2006-144139, or may be a reinforcing fiber base disclosed in other documents.

For example, the reinforcing fiber base 6 is made of weft yarns comprising multifilament twisted yarns of 5,000 dtex made of polyethylene terephthalate (PET) and warp yarns comprising multifilament yarns of 550 dtex. The reinforcing fiber base 6 is in the form of a grid-like web wherein the warp yarns are sandwiched by the weft yarns and the crossings of the warp yarns and the weft yarns are joined by a urethane adhesive.

The reinforcing fiber base 6 may include aramid fibers or polyamide fibers such as Nylon 6, 6, Nylon 6, 10, Nylon 6, or the like, instead of the polyethylene terephthalate fibers. The warp yarns and the weft yarns may be made of fibers which are different from each other. The warp yarns and the weft yarns may have different thicknesses such that one of them has a thickness of 800 dtex and the other a thickness of 7,000 dtex.

The polyurethane of the outer circumferential layer 2*a* of the shoe press belt 10 is produced by curing a composition comprising a mixture of a urethane prepolymer and a curing agent.

As described above, the polyurethane comprises a mixture of the urethane prepolymer (A) described below and the curing agent (B) described blow which has the active hydrogen group (H). The urethane prepolymer (A) and the curing agent (B) are mixed such that the equivalent ratio (H/NCO) of an active hydrogen group (H) of the curing agent (B) and an isocyanate group (NCO) of the urethane prepolymer has a value in the range of 0.88≦H/NCO≦1.12.

The urethane prepolymer (A) is produced by reacting an isocyanate compound (a) containing 55 to 100 molar % of an isocyanate compound, selected from a p-phenylene-diisocyanate and 4,4'-methylene-bis(phenyl isocyanate), with polytetramethylene glycol (b), which has a terminal isocyanate group.

The curing agent (B) contains 85 to 99.9 molar % of 1,4-butanediol and 15 to 0.1 molar % of aromatic polyamine having an active hydrogen group (H). The molar percent refers to the ratios of the active hydrogen group of 1,4-butanediol and the active hydrogen group of aromatic polyamine to the active hydrogen group (H) of the curing agent.

Originally, since a terminal NCO group of the urethane prepolymer (A) containing 55 to 100 molar % of p-phenylene diisocyanate as the primary component of the isocyanate compound easily absorbs water in the atmosphere, the urethane prepolymer has to be reacted with the curing agent in a water-free closed system.

However, the outer circumferential polyurethane layer according to the present invention employs aromatic polyamine as a subsidiary component of the curing agent of 1,4-butanediol for suppressing the effect of water at the time the urethane prepolymer is cured.

As a result, though the outer circumferential polyurethane layer has a "JIS A hardness" ranging from 92 to 100 (preferably from 95 to 100), it exhibits excellent wear resistance, crack resistance, and flexural fatigue resistance.

The isocyanate compound (a) is a material of the urethane prepolymer (A). The isocyanate compound (a) can be used if it contains 55 to 100 molar % (preferably 75 molar % or more) of an isocyanate compound selected from p-phenylene diisocyanate (PPDI) and 4,4'-methylene-bis-phenyl isocyanate (MDI), as primary components, in the isocyanate compound (a).

Isocyanate compounds other than PPDI and MDI include 2,4-tolylene-diisocyanate (2,4-TDI), 2,6-tolylene-diisocyanate (2,6-TDI), and 1,5-naphthalene-diisocyanate (NDI). These isocyanate compounds can be used in combination with the isocyanate compound (a) if 45 molar % or smaller (preferably 25 molar % or smaller) thereof is contained in the isocyanate compound (a).

In some cases, the proportion of linear molecules of p-phenylene diisocyanate (PPDI) and 4,4'-methylene-bis-phenyl isocyanate (MDI) in the isocyanate compound (a) is smaller than 55 molar %. In such cases, it is difficult for the resultant polyurethane to have greatly increased hardness, crack resistance, and wear resistance.

Polyol may be used as a material of the urethane prepolymer (A). Polyol can be used if it contains 65 to 100 molar % (preferably 85 molar % or more) of polytetramethylene glycol (PTMG) (b) in the polyol.

Polyol other than PTMG include polyoxypropylene glycol (PPG), polyethylene adipate (PEA), polycaprolactone diol (PCL) and trimethylolpropane (TMP), which can be used if 35 molar % (preferably 15 molar % or smaller) thereof is contained in the polyol.

The curing agent (B) contains as its primary component 85 to 99.9 molar % (preferably 90 to 99.5 molar %) of linear molecules of 1,4-butanediol.

Aromatic polyamine is a subsidiary component of the curing agent (B). Aromatic polyamine is selected from a mixture of 3,5-diethyltoluene-2,4-diamine and 3,5-diethyltoluene-2,6-diamine (trade name: ETHACURE100), 4,4'-bis(2-chloroaniline), a mixture of 3,5-dimethylthio-2,4-toluenediamine and 3,5-dimethylthio-2,6-toluenediamine (trade name: ETHACURE300), 4,4'-bis(sec-butylamino)-diphenylmethane, N,N'-dialkyldiaminodiphenylmethane, 4,4'-methylenedianiline (MDA), 4,4'-methylene-bis(2,3-dichloroaniline) (TCDAM), 4,4'-methylene-bis(2-chloroaniline) (MOCA), 4,4'-methylene-bis(2-ethyl-6-methylaniline) (trade name: CUREHARD MED), trimethylene-bis(4-aminobenzoate) (trade name: CUA-4), and m-phenylenediamine (MPDA). 15 to 0.1 molar % (preferably 10 to 0.5 molar %) of a mixture of one or two or more of aromatic polyamines having a molecular weight in the range from 108 to 380 (preferably in the range from 198 to 342) is combined with the curing agent (B).

If the proportion of the aromatic polyamine in the curing agent (B) is smaller than 0.1 molar %, then the wear resistance of polyurethane is less increased. If the proportion of the aromatic polyamine in the curing agent (B) is equal to or greater than 15 molar %, then the flexural resistance of polyurethane is less increased than commercially available products.

The shoe press belt (10) may have a single polyurethane layer as shown in FIG. 1(A) or may be of a multilayer structure of polyurethane as shown in FIGS. 1(B) and 1(C).

For example, the shoe press belt (10) shown in FIG. 1(B) has the reinforcing fiber base 6 and the polyurethane layer which are integral with each other. The reinforcing fiber base 6 is embedded in the polyurethane layer. The outer circumferential layer 2*a* and the inner circumferential layer 2*b* are made of polyurethane.

The polyurethane of the outer circumferential layer 2*a* comprises a mixture of the urethane prepolymer (A) described below and the curing agent (B) described blow which has the active hydrogen group (H). The urethane prepolymer (A) and the curing agent (B) are mixed such that the equivalent ratio (H/NCO) of an active hydrogen group (H) of the curing agent (B) and an isocyanate group (NCO) of the urethane prepolymer (A) has a value in the range of 0.88≦H/NCO≦1.12.

The urethane prepolymer (A) is produced by reacting with an isocyanate compound, containing 55 to 100 molar % of p-phenylene diisocyanate, and polytetramethylene glycol, and has a terminal isocyanate group.

The curing agent (B) contains 85 to 99.9 molar % of 1,4-butanediol and 15 to 0.1 molar % of aromatic polyamine having an active hydrogen group (H).

When a composition comprising a mixture of the urethane prepolymer and the curing agent is cured by being heated at 70 to 140° C. for 2 to 20 hours, polyurethane having a "JIS A hardness" ranging from 92 to 100 is produced.

The inner circumferential polyurethane layer 2*b* with the reinforcing fiber base 6 embedded therein is formed of polyurethane.

The polyurethane comprises a mixture of a urethane prepolymer and a curing agent. The urethane prepolymer and the curing agent are mixed such that the equivalent ratio (H/NCO) of an active hydrogen group (H) of the curing agent and an isocyanate group (NCO) of the urethane prepolymer has a value in the range of 0.93<H/NCO<1.05.

The urethane prepolymer is produced by reacting 4,4'-methylene-bis(phenyl isocyanate) with polytetramethylene glycol, and has a terminal isocyanate group. The curing agent is selected from 3,5-dimethylthiotoluenediamine and 1,4-butanediol.

When a composition comprising a mixture of the urethane prepolymer and the curing agent is cured by being heated at 70 to 140° C. for 2 to 20 hours, polyurethane having a "JIS A hardness" ranging from 92 to 100 is produced.

The shoe press belt for papermaking 10 shown in FIG. 1(C) has the reinforcing fiber base 6 and the polyurethane layer which are integral with each other. The reinforcing fiber base 6 is embedded in the intermediate polyurethane layer 2*c*. The outer circumferential polyurethane layer 2*a* and the inner circumferential polyurethane layer 2*b* are disposed on respective both sides of the intermediate polyurethane layer 2*c*.

The outer circumferential polyurethane layer 2*a* and the inner circumferential polyurethane layer 2*b* are made of polyurethane. The polyurethane comprises a mixture of the urethane prepolymer (A) and the curing agent (B) having the active hydrogen group (H), which are mixed such that the equivalent ratio (H/NCO) of the active hydrogen group (H) of the curing agent (B) and the isocyanate group (NCO) of the urethane prepolymer has a value in the range of $0.88 \leqq H/NCO \leqq 1.12$.

When a composition comprising the mixture of the urethane prepolymer and the curing agent is cured by being heated, polyurethane layers having a "JIS A hardness" ranging from 92 to 100 are produced.

The intermediate layer 2*c* with the reinforcing fiber base 6 embedded therein is formed of polyurethane. The polyurethane comprises a mixture of a urethane prepolymer and a curing agent, which are mixed such that the equivalent ratio (H/NCO) of an active hydrogen group (H) of the curing agent and an isocyanate group (NCO) of the urethane prepolymer has a value in the range of $0.93 < H/NCO <$ The urethane prepolymer is produced by reacting 4,4'-methylene-bis(phenyl isocyanate) with polytetramethylene glycol (b), and has a terminal isocyanate group. The curing agent is selected from 3,5-dimethylthiotoluenediamine and 1,4-butanediol.

When a composition comprising a mixture of the urethane prepolymer and the curing agent is cured by being heated at 70 to 140° C. for 2 to 20 hours, polyurethane having a "JIS A hardness" ranging from 92 to 100 is produced.

The shoe press belt 10 has a multilayer polyurethane structure. Within the range of 70 molar % or smaller (preferably 45 molar % or smaller) of the polyol isocyanate compound, other polyol isocyanate compound may be used as a part of the prepolymer components in the belt 10. Other curing agents having an active hydrogen group may also be used in combination.

A method of manufacturing the shoe press belt 10 will be described below.

First, a parting agent is applied to the surface of a mandrel. While the mandrel is rotating, a mixture of a urethane prepolymer and a curing agent for producing the inner circumferential polyurethane layer 2*b* is applied to the surface of the mandrel. The mixture is applied to deposit the inner circumferential polyurethane layer to a thickness in the range from 0.8 to 3.5 mm. The applied layer of the mixture is then precured by being heated at 70 to 140° C. for 0.5 to 1 hour.

The reinforcing fiber base 6 is placed on the inner circumferential polyurethane layer 2*b*. Then, a mixture of a urethane prepolymer and a curing agent for producing the intermediate layer 2*c* is applied to a thickness ranging from 0.5 to 2 mm to impregnate the base 6 and bonded to the inner circumferential polyurethane layer. The applied layer of the mixture is precured at 50 to 120° C. for 0.5 to 1 hour. The intermediate polyurethane layer 2*c* reinforced with the fiber base is now produced.

Thereafter, while the mandrel is rotating, a mixture of a urethane prepolymer and a curing agent for producing the outer circumferential polyurethane layer 2*a* is applied to the surface of the reinforcing fiber woven base 6. The mixture is applied to deposit the outer circumferential polyurethane layer 2*a* to a thickness in the range from 1.5 to 4 mm. The applied layer of the mixture is then cured by being heated at 70 to 140° C. for 2 to 20 hours.

Thereafter, if necessary, the concave grooves 24 shown in FIG. 4 are formed in the outer circumferential polyurethane layer 2*a*. While the polyurethane layer is being cured with heat, a heated embossing roll having ridges complementary to the depth of the concave grooves 24 on its surface may be used and pressed against the outer circumferential polyurethane layer 2*a* being cured, and thereby the concave grooves 24 in the outer circumferential polyurethane layer 2*a* is formed. The mandrel incorporates a heating device therein.

Another method of manufacturing the shoe press belt 10 will be described below.

First, a parting agent is applied to the surface of a mandrel. Then, a mixture of a urethane prepolymer and a curing agent for producing the inner circumferential polyurethane layer 2*b* is applied to the mandrel. The mixture is applied to deposit a polyurethane layer to a thickness in the range from 0.8 to 3 mm, and then precured by being heated at 70 to 140° C. for 0.5 to 2 hours.

The reinforcing fiber base 6 is then placed on the outer surface of the cured polyurethane layer. Thereafter, a mixture of a urethane prepolymer and a curing agent for producing the intermediate layer 2*c* is applied to a thickness ranging from 0.5 to 2 mm to impregnate the fiber base 6 and bonded to the inner circumferential layer 2*b*. The applied layer of the mixture is precured at 50 to 120° C. for 0.5 to 1 hour, and thereby the intermediate polyurethane layer 2*c* reinforced with the fiber base 6 is produced.

Then, a mixture of the urethane prepolymer (A) and the curing agent (B) for producing the outer circumferential layer 2*a* is applied to form the outer circumferential polyurethane layer 2*a* having a thickness in the range from 2 to 4 mm, and then post-cured at 70 to 140° C. for 4 to 16 hours.

Then, concave grooves 24 are formed in the surface of the outer circumferential polyurethane layer 2*a* with the reinforcing fiber base 6 embedded therein by a cutting tool, after which the surface of the outer circumferential polyurethane layer 2*a* is polished by sandpaper or a polyurethane polishing cloth.

A method of manufacturing the shoe press belt 10 having the intermediate layer 2*c* will be described below.

First, a parting agent is applied to the surface of a mandrel. Then, a mixture of a urethane prepolymer and a curing agent for producing the inner circumferential layer 2*b* is applied to the surface of the mandrel to deposit the inner circumferential layer 2*b* to a thickness in the range from 0.6 to 3 mm. The mixture is then precured by being heated at 50 to 140° C. for 0.5 to 2 hours.

Then, the prefabricated intermediate polyurethane layer 2*c* having a thickness ranging from 1 to 2 mm with the reinforcing fiber base 6 embedded therein is wound around the outer surface of the inner circumferential layer 2*b*. Then, the intermediate layer 2*c* is pressed by a nip roll which is heated to 50 to 140° C.

Furthermore, a mixture of the urethane prepolymer (A) and the curing agent (B) for producing the outer circumferential layer 2*a* is applied to form the outer circumferential polyurethane layer 2*a* having a thickness in the range from 2 to 4 mm, and then post-cured at 90 to 140° C. for 2 to 20 hours.

Then, the outer circumferential surface of the polyurethane layer with the reinforcing fiber base 6 embedded therein is polished by a sandpaper or a polyurethane polishing cloth. Thereafter, concave grooves 24 are formed in the surface of the outer circumferential layer 2*a* by a cutting tool.

A method of manufacturing the shoe press belt 10 using two rolls instead of the mandrel will be described below.

According to the present method, the reinforcing fiber woven base 6 is stretched between the two rolls. A mixture of a urethane prepolymer and a curing agent is applied to the surface of the reinforcing fiber base 6 to impregnate the fiber base 6, and then precured at 50 to 120° C. for 0.5 to 3 hours.

Thereafter, a mixture of a urethane prepolymer and a curing agent for producing the inner circumferential polyurethane layer 2*b* is applied to deposit the inner circumferential polyurethane layer 2*b* to a thickness in the range from 0.5 to 3 mm. The mixture is cured at 70 to 140° C. for 2 to 12 hours, and its surface is polished by sandpaper or a polishing cloth. In this manner, a partly finished product of integral structure including the inner circumferential polyurethane layer 2*b* and the reinforcing fiber base 6 which are bonded to each other is produced.

Then, the partly finished product is reversed and stretched on and between the two rolls. The surface of the stretched partly finished product is coated with a mixture of a urethane prepolymer and a curing agent to impregnate the fiber base 6 with the mixture.

The surface is then coated with a mixture of the urethane prepolymer (A) and the curing agent (B) to a thickness ranging from 1.5 to 4 mm, and the mixture is cured at 70 to 140° C. for 2 to 20 hours. After the curing is finished, the surface layer is polished to a given thickness, and concave grooves 24 are formed therein by a cutting tool to produce the outer circumferential layer 2*a*.

EMBODIMENTS

The production of polyurethane test pieces for evaluating the properties of polyurethane of the shoe press belt 10 will be described below.

Reference Example 1

A urethane prepolymer is produced by reacting p-phenylene diisocyanate (PPDI) with polytetramethylene glycol (PTMG). A curing agent mixture consisting of 97 molar % of 1,4-butanediol (1,4BD) and 3 molar % of 3,5-diethyltoluenediamine (ETHACURE100) was prepared.

The urethane prepolymer (NCO percent is 5.51%, the viscosity at 55° C. is 1,800 cps, and the preheating temperature is 66° C.) and the curing agent mixture are mixed with each other. The H/NCO equivalent ratio in this case is 0.95. The polyurethane resin mixture will briefly be referred to as "PPDI/PTMG/1,4BD+ETHACURE100: H/NCO=0.95".

The mixture thus obtained is poured into a mold assembly preheated to 127° C. The mold assembly is heated to 127° C. to precure the mixture at 127° C. for 30 minutes. Thereafter, an upper die is removed from the die assembly, and the mixture is post-cured at 127° C. for 16 hours, and thereby a cured polyurethane sheet having a "JIS A hardness" of 98.1 is produced. Test pieces (thickness of 1.5 mm) were fabricated from the sheet.

Reference Example 2

A urethane prepolymer is produced by reacting with p-phenylene diisocyanate (PPDI) and polytetramethylene glycol (PTMG). A curing agent mixture consisting of 95 molar % of 1,4-butanediol (1,4BD) and 5 molar % of 3,5-dimethylthiotoluenediamine (ETHACURE300) was prepared.

The urethane prepolymer (NCO percent is 5.51%, the viscosity at 55° C. is 1,800 cps, and the preheating temperature is 66° C.) and the curing agent mixture are mixed with each other. The H/NCO equivalent ratio in this case is 0.95.

The mixture thus obtained is poured into a mold assembly preheated to 127° C. The mold assembly is heated to 127° C. to precure the mixture at 127° C. for 30 minutes. Thereafter, an upper die is removed from the die assembly, and the mixture is post-cured at 127° C. for 16 hours, and thereby a cured polyurethane sheet having a "JIS A hardness" of 98.2 is produced. Test pieces (having a thickness of 1.5 mm) were fabricated from the sheet.

Reference Example 3 (For Comparison)

A urethane prepolymer is produced by reacting with p-phenylene diisocyanate (PPDI) and polytetramethylene glycol (PTMG).

A composition is then produced from the urethane prepolymer (NCO percent is 5.51%, the viscosity at 55° C. is 1,800 cps, and the preheating temperature is 66° C.) and 1,4-butanediol (1,4BD). The H/NCO equivalent ratio in this case is 0.95.

The composition thus obtained is poured into a mold assembly preheated to 127° C. The mold assembly is heated to 127° C. to precure the composition at 127° C. for 30 minutes. Thereafter, an upper die is removed from the die assembly, and the composition is post-cured at 127° C. for 16 hours, and thereby a cured polyurethane sheet having a "JIS A hardness" level of 98.1 is produced. Test pieces (having a thickness of 1.5 mm) were fabricated from the sheet.

Reference Example 4

A urethane prepolymer is produced by reacting with p-phenylene diisocyanate (PPDI) and polytetramethylene glycol (PTMG). A curing agent mixture consisting of 90 molar % of 1,4-butanediol (1,4BD) and 10 molar % of 3,5-dimethylthiotoluenediamine (ETHACURE300) was prepared.

The urethane prepolymer (NCO percent is 3.03%, the viscosity at 70° C. is 7,000 cps, and the dissolving temperature is 100° C.) and the curing agent mixture are mixed with each other. The H/NCO equivalent ratio in this case is 0.95.

The mixture thus obtained is poured into a mold assembly preheated to 127° C. The mold assembly is heated to 127° C. to precure the mixture at 127° C. for 60 minutes. Thereafter, the mixture is post-cured at 127° C. for 16 hours, and thereby a cured polyurethane sheet having a "JIS A hardness" of 95.6 is produced. Test pieces (having a thickness of 1.5 mm) were fabricated from the sheet.

Reference Example 5 (For Comparison)

A urethane prepolymer is produced by reacting with a mixture (TDI), of 2,4-tolylene-diisocyanate and 2,6-tolylene-diisocyanate, and polytetramethylene glycol (PTMG).

A composition is produced from the urethane prepolymer (NCO percent is 6.02%, the viscosity at 80° C. is 400 cps, and the preheating temperature is 66° C.) and 3,5-dimethylthiotoluenediamine (ETHACURE300). The H/NCO equivalent ratio in this case is 0.95.

The composition is poured into a preheated mold assembly. The mold assembly is heated to 100° C. to precure the composition at 100° C. for 30 minutes. Thereafter, the composition is post-cured at 100° C. for 16 hours, and thereby a cured polyurethane sheet having a "JIS A hardness" of 96.2 is produced. Test pieces (having a thickness of 1.5 mm) were fabricated from the sheet.

Reference Examples 6 Through 8 (For Comparison)

FIGS. 8 and 9 are tables showing experimental data, and both show overall experimental data. From the urethane prepolymer and the curing agents shown in FIGS. 8 and 9, test pieces (having a thickness of 1.5 mm) were produced of polyurethane sheets in the same manner as with Reference example 1 under the molding conditions shown in FIGS. 8 and 9.

The compounded amount of each of the curing agents shown in FIGS. 8 and 9 refers to parts by weight of the curing agent with respect to 100 parts by weight of the urethane prepolymer.

The obtained test pieces were tested for "JIS A hardness", tensile strength (JIS K6251: Dumbbell No. 3, tension rate of 500 mm/minute), and tear resistance (JIS K6252, tear rate of 500 mm/minute, notched angle). The properties of the test pieces were evaluated by a wear test and a De Mattia flexing test. The obtained properties are shown in FIGS. 8, 9 and 10.

Stress vs. strain curves of various polyurethanes (Reference examples 1, 2, 3, 4, 5 and 8) are shown in FIG. 2. The vertical and horizontal axes of FIG. 2 represent stresses and strains, respectively.

FIG. 3 is a diagram showing a correlation between stresses (vertical axis) and strains (horizontal axis) with respect to tear resistance for notched angles made of various polyurethanes.

In the wear test, the apparatus disclosed in JP, A, 2006-144139 was used. Each of the test pieces was attached to a lower portion of a press board, and a rotating roll having a friction member on its outer circumferential surface was rotated while being pressed against a lower surface (a surface to be measured) of the test piece.

The rotating roll applied a pressure of 9.6 kg/cm. and was rotated at a rotational speed of 100 m/minute for 20 minutes. After the rotation, a reduction in the thickness of the belt sample (i.e., a depth of wear) was measured.

The flexural test used a tester, shown in FIG. 6, similar to the De Mattia flexing test machine defined by JIS-K-6260 (2005). Using the tester, the test pieces were tested for crack development at a temperature of 20° C. and a relative humidity of 52% under the following conditions:

A test piece 61 had a size represented by a width of 25 mm and a length of 185 mm (including a gripping allowance (20 mm on each side)), and a pair of grippers 62 were spaced apart from each other by a distance of 150 mm and had a thickness of 3.4 mm. The test piece 61 had a semicircular dimple 61*a* defined centrally therein which had a radius of 1.5 mm.

One of the grippers 62 was reciprocally moved as indicated by the arrow F over a distance of 65 mm at a reciprocating rate of 360 reciprocating strokes/minute, the grippers 62 being spaced from each other by a maximum distance of 100 mm and a minimum distance of 35 mm.

A notch was defined centrally in the test piece 61 and had a length of about 2 mm in the transverse direction of the test piece 61. The test piece 61 was inclined at an angle of 45° to the direction in which the grippers 62 are relatively reciprocally moved as indicated by the arrow F.

Under the above conditions, the test piece 61 was repeatedly flexed and measured for the length of a crack each time a certain stroke count was reached. The stroke count refers to a value produced by multiplying the test time by the reciprocating rate. FIG. 10 is a table showing experimental data and shows crack lengths for respective stroke counts in the respective examples.

The test was finished at the time the crack length, starting from the initial measured notch length value (about 2 mm) exceeded 15 mm. Approximate curves were plotted based on the stroke counts and the crack lengths, and the stroke counts at the crack length of 15 mm were read from the approximate curves. Values produced by dividing the grown crack lengths (the crack length of 15 mm—the initial measured notch length value) by the corresponding stroke counts were used as De Mattia flexing test results.

It can be seen from FIGS. 8, 9 and 10 that the test pieces 61 according to Reference examples 1, 2 and 3 have depths of wear smaller than 0.1 mm and appreciate much smaller wear than the test pieces according to Comparative examples.

Comparison of the flexural resistances against the small depths of wear confirms that Reference examples 1 and 2 make it possible to produce shoe press belts 10 which have excellent mechanical properties in wear resistance and flexural fatigue resistance, compared with the shoe press belt according to the background art (Comparative example 2).

Shoe press belts 10 manufactured using the polyurethanes according to Reference examples 1 through 8 will be described below.

Inventive Example 1

Step 1: A mandrel has a diameter of 1,500 mm and can be rotated about its own axis by a suitable drive means. The mandrel has a polished surface coated with a parting agent (KS-61: manufactured by Shin-Etsu Chemical Co., Ltd.).

Then, the urethane prepolymer (PDDI/PTMG prepolymer) according to Reference example 1 is prepared. A curing agent mixture is prepared of 97 molar % of 1,4-butanediol (manufactured by Mitsubishi Chemical Co., Ltd.) and 3 molar % of 3,5-diethyltoluenediamine (ETHACURE100). The urethane prepolymer and the curing agent mixture are mixed with each other such that the H/NCO equivalent ratio is 0.95, and thereby a polyurethane resin mixture is produced.

The mandrel is rotated. The mandrel which is being rotated is spirally coated with the polyurethane resin mixture to a thickness of 1.4 mm by a pouring formation nozzle which is movable parallel to the rotational axis of the mandrel (this coating process will hereinafter referred to as "spiral coating"). In this manner, a polyurethane resin layer is produced.

The polyurethane resin layer is left to stand at the room temperature (30° C.) for 40 minutes while the mandrel is being rotated. The polyurethane resin mixture is precured by being heated at 127° C. for 30 minutes by a heater combined with the mandrel. In this manner, a shoe-side inner circumferential polyurethane layer 2*b* is produced.

Step 2: Multifilament twisted yarns of 5,000 dtex made of polyethylene terephthalate fiber are used as weft yarns. Multifilament yarns of 550 dtex made of polyethylene terephthalate fiber are used as warp yarns. A grid-like web wherein the warp yarns are sandwiched by the weft yarns and the crossings of the warp yarns and the weft yarns are joined by a urethane adhesive is prepared (the warp yarn density is one yarn/cm., and the weft yarn density is four yarns/cm.).

Pluralities of grid-like webs are placed as one layer, without gaps therebetween, on the outer circumferential surface of the shoe-side layer such that the weft yarns extend along the axial direction of the mandrel.

Then, multifilament yarns of 6,700 dtex of polyethylene terephthalate fiber are helically wound around the outer circumferential surfaces of the grid-like webs at a pitch of 30 yarns/5 cm, and thereby a wound-yarn layer is produced.

Thereafter, the polyurethane resin mixture is applied as an intermediate layer to a thickness of about 1.6 mm sufficiently to close the gap between the grid-like webs and the wound-yarn layer, and thereby the grid-like webs and the wound-yarn layer are integrally joined. In this manner, an intermediate polyurethane layer 2*c* having a reinforcing fiber base 6 is produced.

Step 3: The same polyurethane resin mixture as the polyurethane resin mixture used to make the shoe-side layer is applied to the wound-yarn layer to a thickness of about 2.5 mm by spiral coating, thereby impregnating the wound-yarn layer. Then, the assembly is left to stand at the room temperature for 40 minutes, and thereafter post-cured by being heated at 127° C. for 16 hours, and thereby a wet paper web-side layer (an outer circumferential polyurethane layer 2*a*) is produced.

Then, the surface of the wet paper web-side layer is polished until the overall thickness becomes 5.2 mm. Thereafter, a number of concave grooves (a groove width of 0.8 mm, a depth of 0.8 mm, and a pitch of 2.54 mm) 24 are formed in the MD (Machine Direction) of the belt 10 (stated otherwise, the direction in which the belt 10 runs (flows)), using a rotating blade. In this manner, the shoe press belt 10 is produced. The CMD (Cross Machine Direction) of the belt 10 is a transverse direction of the belt 10.

Inventive Example 2

In Inventive example 1, the polyurethane resin mixture according to Reference example 2 is used instead of the polyurethane resin mixture according to Reference example 1. The polyurethane resin mixture comprises a mixture of the PPDI/PTMG prepolymer and the mixed curing agent made of 1,4-butanediol and ETHACURE300. Other procedural details which are the same as those of Inventive example 1 are employed to produce the shoe press belt 10.

Applied Reference Example 1

In Inventive example 1, the polyurethane resin mixture (the mixture of the PPDI/PTMG prepolymer and 1,4-butanediol according to Reference example 3) is used instead of the polyurethane resin mixture according to Reference example 1. Other procedural details which are the same as those of Inventive example 1 are employed to produce the shoe press belt 10.

Comparative Example 1

In Inventive example 1, the polyurethane mixture (the mixture of the TDI/PTMG prepolymer and ETHACURE300) according to Reference example 5 is used instead of the polyurethane resin mixture according to Reference example 1. The curing conditions are changed such the mixture is precured at 100° C. for 30 minutes and post-cured at 100° C. for 16 hours, and other procedural detail which are same as those of Inventive example 1 are employed to produce the shoe press belt 10.

Comparative Example 2

In Inventive example 1, the polyurethane resin mixture (the mixture of the MDI/PTMG prepolymer and 1,4BD) according to Reference example 8 is used instead of the polyurethane resin mixture according to Reference example 1.

The curing conditions are changed such the polyurethane resin mixture is precured at 115° C. for 1 hour and post-cured at 115° C. for 16 hours, and other procedural details are same as those of Inventive example 1 are employed to produce the shoe press belt 10.

Inventive Example 3

In Inventive example 1, the polyurethane resin mixture produced by mixing the urethane prepolymer and the curing agent mixture (the equivalent ratio (H/NCO) is 0.95) according to Reference example 4 is used instead of the polyurethane resin mixture according to Reference example 1.

The urethane prepolymer is produced by reacting with p-phenylene diisocyanate (PPDI) and polytetramethylene glycol (PTMG). Of the urethane prepolymer, NCO percent is 5.51%, the viscosity at 55° C. is 1,800 cps, and the preheating temperature is 66° C. The curing agent mixture is produced of 90 molar % of 1,4-butanediol (1,4BD) and 10 molar % of ETHACURE300.

According to Inventive example 3, except that the above polyurethane resin mixture is used, the same procedural details as those of Inventive example 1 are employed to produce the shoe press belt 10.

A wear test and a flexural test were conducted on the shoe press belts 10 thus produced. In the wear test on the belt samples, grooved product belt samples were evaluated. Since the grooves product belt samples tend to have a greater depth of wear than planar resin test samples, they were tested under following test conditions:

In the wear test, the apparatus disclosed in JP, A, 2006-144139 was used. Each of the belt samples was attached to a lower portion of a press board, and a rotating roll having a friction member on its outer circumferential surface was rotated while being pressed against a lower surface (a surface to be measured) of the belt sample.

The rotating roll applied a pressure of 6.6 kg/cm and was rotated at a rotational speed of 100 m/minute for 45 seconds. After the belt sample was rotated, a reduction in the thickness of the belt sample (i.e., a depth of wear) was measured.

The depth of wear (the average value of the depths of wear measured in five repeated cycles) was 0.076 mm for Inventive example 1, 0.105 mm for Inventive example 2, 0.137 mm for Inventive example 3, 0.213 mm for Applied reference example 1, 0.269 mm for Comparative example 1, and 2.230 mm for Comparative example 2.

The flexural fatigue test was conducted on grooved prototype product belt samples. In the flexural fatigue test, an apparatus shown in FIG. 7 was used to produce cracks at a temperature of 20° C. and a relative humidity of 52% under the following conditions:

A test piece 71 had a width of 60 mm, and a pair of grippers 72*a*, 72*b* was spaced apart from each other by a distance of 70 mm. The lower gripper 72*a* was reciprocally moved along an arcuate path as indicated by the arrow G. The upper gripper 72*b* and the test piece 71 were also reciprocally moved, causing the distal end of the lower gripper 72*a* to flex and fatigue the test piece 71.

The distance from the center of the arcuate path to the distal end of the lower gripper was 168 mm, the distance that the lower gripper 72*a* moves was 161 mm, and the reciprocating rate of the lower gripper 72*a* was 162 reciprocating strokes/minute. The upper gripper 72*b* had a weight of 400 g. The test piece 71 was repeatedly flexed under the above conditions, and the number of times that the test piece 71 was flexed until it cracked was measured.

The measured numbers of times that the test pieces were flexed indicate that the test pieces according to Inventive example 1, Inventive example 2 and Inventive example 3 did not crack when they were flexed 700,000 times, the test piece according to Applied reference example 1 did not crack when it was flexed 700,000 times, the test piece according to Comparative example 1 was disabled when it was flexed 200,000 times, and the test piece according to Comparative example 2 did not crack when it was flexed 700,000 times.

FIG. 11 is a table showing experimental data indicative of the measured depths of wear and numbers of times that the test pieces were flexed. It will be understood from FIG. 11 that the shoe press belts 10 according to Inventive example 1, Inventive example 2 and Inventive example 3 have a wear resistance capability which is twice or three times the shoe press belt according to the background art and the shoe press belts according to the Patent Documents (Comparative example 1), and hence have excellent wear resistance.

It will also be understood that the shoe press belts 10 according to Inventive example 1, Inventive example 2 and Inventive example 3 have a greatly improved durability capability.

Inventive Example 4

Step 1: A mandrel has a diameter of 1,500 mm and can be rotated about its own axis by a suitable drive means. The mandrel has a polished surface coated with a parting agent (KS-61: manufactured by Shin-Etsu Chemical Co., Ltd.).

Then, the urethane prepolymer (PDDI/PTMG prepolymer) according to Reference example 1 is prepared. A curing agent mixture is prepared of 97 molar % of 1,4-butanediol (manufactured by Mitsubishi Chemical Co., Ltd.) and 3 molar % of 3,5-diethyltoluenediamine (ETHACURE100). The urethane prepolymer and the curing agent mixture are mixed with each other such that the H/NCO equivalent ratio is 0.95, and thereby a polyurethane resin mixture is produced.

The mandrel is rotated. The mandrel which is being rotated is coated with the polyurethane resin mixture to a thickness of 1.4 mm by a pouring formation nozzle which is movable parallel to the rotational axis of the mandrel (spiral coating). In this manner, a polyurethane resin layer is produced.

The polyurethane resin layer is left to stand at the room temperature (30° C.) for 40 minutes while the mandrel is being rotated. The polyurethane resin mixture is precured by being heated at 127° C. for 30 minutes by a heater combined with the mandrel. In this manner, a shoe-side inner circumferential polyurethane layer 2*b* is produced.

Step 2: Multifilament twisted yarns of 5,000 dtex made of polyethylene terephthalate fiber are used as weft yarns and multifilament yarns of 550 dtex made of polyethylene terephthalate fiber are used as warp yarns. A grid-like web wherein the warp yarns are sandwiched by the weft yarns and the crossings of the warp yarns and the weft yarns are joined by a urethane adhesive is prepared (the warp yarn density is one yarn/cm., and the weft yarn density is four yarns/cm.).

Pluralities of grid-like webs are placed as one layer, without gaps therebetween, on the outer circumferential surface of the shoe-side layer such that the weft yarns extend along the axial direction of the mandrel.

Then, multifilament yarns of 6,700 dtex of polyethylene terephthalate fiber are helically wound around the outer circumferential surfaces of the grid-like webs at a pitch of 30 yarns/5 cm, and thereby a wound-yarn layer is produced.

Thereafter, the urethane resin mixture (the mixture of the TDI/PTMG prepolymer and ETHACURE300) according to Reference example 6 is applied as an intermediate layer to a thickness of about 1.6 mm sufficiently to close the gap between the grid-like webs and the wound-yarn layer, and thereby the grid-like webs and the wound-yarn layer are integrally joined. In this manner, a reinforcing fiber base 6 is produced.

Step 3: The same polyurethane resin mixture as the polyurethane resin mixture used to make the shoe-side layer is applied to the wound-yarn layer to a thickness of about 2.5 mm by spiral coating, thereby impregnating the wound-yarn layer. Then, the assembly is left to stand at the room temperature for 40 minutes, and thereafter post-cured by being heated at 127° C. for 16 hours, and thereby a wet paper web-side layer (an outer circumferential polyurethane layer 2*a*) is produced.

Then, the surface of the wet paper web-side layer is polished until the overall thickness becomes 5.2 mm. Thereafter, a number of concave grooves (a groove width of 0.8 mm, a depth of 0.8 mm, and a pitch of 2.54 mm) 24 are formed in the MD direction of the belt 10, using a rotating blade. In this manner, a shoe press belt 10 is produced.

Inventive Example 5

In Inventive example 1, the polyurethane resin mixture according to Reference example 1 is used for the outer circumferential layer 2*a* and the intermediate layer (the impregnated reinforcing base layer) 2*c* of the belt 10. The inner circumferential layer 2*b* is made of the urethane resin mixture (the mixture of the TDI/PTMG prepolymer and ETHACURE300) according to Reference example 6.

The curing conditions are changed such that the mixture is precured at 100° C. for 30 minutes and post-cured at 100° C. for 16 hours, and other procedural details which are the same as those of Reference example 1 are employed to produce the shoe press belt 10.

Inventive Example 6

In Inventive example 1, the polyurethane resin mixture according to Reference example 1 is used for the outer circumferential layer 2*a* and the intermediate layer 2*c*, and the inner circumferential layer 2*b* is made of the polyurethane resin mixture according to Reference example 4.

The polyurethane resin mixture comprises a mixture of a urethane prepolymer, produced by reacting with p-phenylene diisocyanate (PPDI) and polytetramethylene glycol (PTMG), and a curing agent mixture of 90 molar % of 1,4-butanediol (1,4BD) and 10 molar % of ETHACURE300 (the equivalent ratio (H/NCO) is 0.95). Except that the curing condition for the mixture are changed such that the mixture is precured at 127° C. for 1 hour and post-cured at 127° C. for 6 hours, the same procedural details as those of Reference example 1 are employed to produce the shoe press belt 10.

Inventive Example 7

Step 1: A mandrel has a diameter of 1,500 mm and can be rotated about its own axis by a suitable drive means. The mandrel has a polished surface coated with a parting agent (KS-61: manufactured by Shin-Etsu Chemical Co., Ltd.).

Then, the mandrel is rotated. The surface of the mandrel is coated with the polyurethane resin mixture according to Reference example 6 to a thickness of 1.4 mm by spiral coating. The polyurethane resin mixture is a mixture of the TDI/PTMG prepolymer and ETHACURE300, and has an equivalent ratio (H/NCO) of 0.95.

The polyurethane resin mixture is left to stand at the room temperature for 40 minutes while the mandrel is being rotated. The resin is precured by being heated at 100° C. for 30 minutes by a heater combined with the mandrel.

Step 2: A fabric web (a weft mesh of 30 weft yarns/5 cm and a warp mesh of 40 warp yarns/5 cm) are prepared. The fabric web is woven in a single-layer structure wherein monofilament yarns of 800 dtex made of polyethylene terephthalate fiber serve as warp yarns and multifilament yarns of 4,500 dtex made of polyethylene terephthalate fiber serve as weft yarns.

A plurality of fabric webs are placed as one layer, without gaps therebetween, on the outer circumferential surface of the shoe-side layer such that the weft yarns extend along the axial direction of the mandrel.

Then, multifilament yarns of 7,000 dtex of polyethylene terephthalate fiber are helically wound around the outer circumferential surfaces of the woven webs at a pitch of 30 yarns/5 cm, and thereby a wound-yarn layer is produced.

Thereafter, the polyurethane resin mixture (the mixture of the TDI/PTMG prepolymer and ETHACURE300) according to Reference example 6 is applied by a doctor bar to a thickness of 1.6 mm sufficiently to close the gap between the woven webs and the wound-yarn layer, and thereby the woven webs and the wound-yarn layer are integrally joined. In this manner, a reinforcing fiber base 6 is produced.

Step 3: The polyurethane resin mixture (PPDI/PTMG/1,4BD+ETHACURE100: H/NCO=0.95) according to Reference example 1 is applied to the wound-yarn layer to a thickness of about 2.5 mm by spiral coating. Then, the assembly is post-cured by being heated at 127° C. for 16 hours.

Then, the surface of the wet paper web-side layer is polished until the overall thickness becomes 5.2 mm. Thereafter, a number of concave grooves (a groove width of 0.8 mm, a depth of 0.8 mm, and a pitch of 2.54 mm) 24 are formed in the MD direction of the belt 10, using a rotating blade. In this manner, a shoe press belt 10 is produced.

Inventive Example 8

Step 1: A mandrel has a diameter of 1,500 mm and can be rotated about its own axis by a suitable drive means. The mandrel has a polished surface coated with a parting agent (KS-61: manufactured by Shin-Etsu Chemical Co., Ltd.).

Then, while the mandrel is being rotated, the surface of the mandrel is coated with the polyurethane resin mixture according to Reference example 8 to a thickness of 1.4 mm by a doctor bar. The polyurethane resin mixture is a urethane resin mixture (MDI/PTMG/1,4BD+ETHACURE100) wherein 3 molar % of ETHACURE100 is added to 97 molar % of 1,4BD.

While the mandrel is being rotated, the applied layer of the polyurethane resin mixture is left to stand at the room temperature for 40 minutes. The applied polyurethane resin layer is precured by being heated at 115° C. for 60 minutes by a heater combined with the mandrel.

Step 2: Multifilament twisted yarns of 5,000 dtex made of polyethylene terephthalate fiber are used as weft yarns and multifilament yarns of 550 dtex made of polyethylene terephthalate fiber are used as warp yarns. A grid-like web wherein the warp yarns are sandwiched by the weft yarns and the crossings of the warp yarns and the weft yarns are joined by a urethane adhesive is prepared (the warp yarn density is one yarn/cm., and the weft yarn density is four yarns/cm.).

Pluralities of grid-like webs are placed as one layer, without gaps therebetween, on the outer circumferential surface of the shoe-side layer such that the weft yarns extend along the axial direction of the mandrel.

Then, multifilament yarns of 6,700 dtex of polyethylene terephthalate fiber are helically wound around the outer circumferential surfaces of the grid-like webs at a pitch of 30 yarns/5 cm, and thereby a wound-yarn layer is produced.

Thereafter, the polyurethane resin mixture (PPDI/PTMG/1,4BD+ETHACURE100: H/NCO=0.95) according to Reference example 1 is applied by a doctor bar to a thickness of about 1.6 mm sufficiently to close the gap between the grid-like webs and the wound-yarn layer, and thereby the grid-like webs and the wound-yarn layer are integrally joined. In this manner, a reinforcing fiber base 6 is produced.

Step 3: The polyurethane resin mixture (PPDI/PTMG/1,4BD+ETHACURE100: H/NCO=0.95) according to Reference example 1 is applied to the wound-yarn layer to a thickness of about 2.5 mm by spiral coating. Then, the assembly is post-cured by being heated at 127° C. for 16 hours.

Then, the surface of the wet paper web-side layer is polished until the overall thickness becomes 5.2 mm. Thereafter, a number of concave grooves (a groove width of 0.8 mm, a depth of 0.8 mm, and a pitch of 2.54 mm) 24 are formed in the MD direction of the belt 10, using a rotating blade. In this manner, a shoe press belt 10 is produced.

Inventive Example 9

Step 1: A mandrel has a diameter of 1,500 mm and can be rotated about its own axis by a suitable drive means. The mandrel has a polished surface coated with a parting agent (KS-61: manufactured by Shin-Etsu Chemical Co., Ltd.).

Then, while the mandrel is being rotated, the surface of the mandrel is coated with the polyurethane resin mixture according to Reference example 8 to a thickness of 1.4 mm by a doctor bar. The polyurethane resin mixture is a urethane resin mixture (MDI/PTMG/1,4BD+ETHACURE300) wherein 5 molar % of ETHACURE300 is added to 97 molar % of 1,4BD.

While the mandrel is being rotated, the applied layer of the polyurethane resin mixture is left to stand at the room temperature for 40 minutes. The applied polyurethane resin layer is precured by being heated at 100° C. for 60 minutes by a heater combined with the mandrel.

Step 2: Multifilament twisted yarns of 5,000 dtex made of polyethylene terephthalate fiber are used as weft yarns and multifilament yarns of 550 dtex made of polyethylene terephthalate fiber are used as warp yarns. A grid-like web wherein the warp yarns are sandwiched by the weft yarns and the crossings of the warp yarns and the weft yarns are joined by a urethane adhesive is prepared (the warp yarn density is one yarn/cm, and the weft yarn density is four yarns/cm.).

Pluralities of grid-like webs are placed as one layer, without gaps therebetween, on the outer circumferential surface of the shoe-side layer such that the weft yarns extend along the axial direction of the mandrel.

Then, multifilament yarns of 6,700 dtex of polyethylene terephthalate fiber are helically wound around the outer circumferential surfaces of the grid-like webs at a pitch of 30 yarns/5 cm, and thereby a wound-yarn layer is produced.

Thereafter, the polyurethane resin mixture (MDI/PTMG/1,4BD+ETHACURE300) used in Step 1 is applied to a thickness of about 1.6 mm sufficiently to close the gap between the grid-like webs and the wound-yarn layer, and thereby the grid-like webs and the wound-yarn layer are integrally joined. In this manner, a reinforcing fiber base 6 is produced.

Step 3: The polyurethane resin composition (PPDI/PTMG/1,4BD+ETHACURE100) according to Reference example 1 is applied by a doctor bar to the wound-yarn layer to a thickness of about 2.5 mm, thereby impregnating the wound-yarn layer. Then, the assembly is post-cured by being heated at 127° C. for 16 hours.

Then, the surface of the wet paper web-side layer is polished until the overall thickness becomes 5.2 mm. Thereafter, a number of concave grooves (a groove width of 0.8 mm, a depth of 0.8 mm, and a pitch of 2.54 mm) 24 are formed in the MD direction of the belt 10, using a rotating blade. In this manner, a shoe press belt 10 is produced.

The shoe press belt 10 according to the present invention, which is constructed as described above, has excellent wear resistance, crack resistance and flexural fatigue resistance compared with existing products, and can withstand usage as twice as existing shoe press belts.

While the embodiments of the present invention have been described above, the present invention is not limited to the above embodiments, but various modifications and additions may be made within the scope of the present invention.

Identical reference characters denote identical or corresponding parts through views.

INDUSTRIAL APPLICABILITY

The shoe press belt according to the present invention is applicable to a closed-type shoe press for papermaking.

The invention claimed is:

1. A shoe press belt, comprising a reinforcing fiber base and a polyurethane layer that are integral with each other, the reinforcing fiber base being embedded in the polyurethane layer, wherein:

the polyurethane layer comprises a polyurethane produced by curing a mixed composition of a urethane prepolymer (A) and an active hydrogen group (H) containing curing agent (B);

the urethane prepolymer (A) has a terminal isocyanate group, and is obtained by reacting an isocyanate compound (a) with polytetramethylene glycol (b);

the isocyanate compound (a) comprises 55 to 100 molar % of p-phenylene diisocyanate; and the curing agent (B) comprises 85 to 99.9 molar % of 1,4-butanediol and 15 to 0.1 molar % of an aromatic polyamine including the active hydrogen group (H).

2. A shoe press belt according to claim 1, wherein said aromatic polyamine having said active hydrogen group (H) is a mixture of one or more aromatic polyamines selected from 3,5-diethyltoluene-2,4-diamine, 3,5-diethyltoluene-2,6-diamine, 3,5-dimethylthiotoluene-2,4-diamine, 3,5-dimethylthiotoluene-2,6-diamine, 4,4'-bis(2-chloroaniline), 4,4'-bis(sec-butylamino)-diphenylmethane, N,N'-dialkyldiaminodiphenyl-methane, 4,4'-methylenedianiline, 4,4'-methylene-bis(2,3-dichloroaniline), 4,4'-methylene-bis(2-chloroaniline), 4,4'-methylene-bis(2-ethyl-6-methylaniline), trimethylene-bis(4-aminobenzoate) and phenylenediamine.

3. A shoe press belt , comprising a reinforcing fiber base and a polyurethane layer that are integral with each other, wherein:

the polyurethane layer comprises an outer circumferential polyurethane layer and an inner circumferential polyurethane layer;

the outer circumferential polyurethane layer is made of a polyurethane produced by curing a mixed composition of a urethane prepolymer (A) and a curing agent (B);

the urethane prepolymer (A) has a terminal isocyanate group, and is obtained by reacting an isocyanate compound (a) with polytetramethylene glycol (b);

the isocyanate compound (a) comprises 55 to 100 molar % of an isocyanate selected from p-phenylene diisocyanate and 4,4'-methylene-bis(phenyl isocyanate);

the curing agent (B) comprises 85 to 99.9 molar % of 1,4-butanediol and 15 to 0.1 molar % of an aromatic polyamine including the active hydrogen group (H);

the reinforcing fiber base is embedded in the inner circumferential polyurethane layer; and the inner circumferential polyurethane layer is:

made of a polyurethane produced by curing a mixed composition of a terminal isocyanate group containing urethane prepolymer obtained by reacting 4,4'-methylene-bis(phenyl isocyanate) with polytetramethylene glycol, and a curing agent selected from 3,5-dimethylthiotoluenediamine, 3,5-diethyltoluenediamine, and 1,4-butanediol; or made of a polyurethane produced by curing a mixed composition of a terminal isocyanate group containing urethane prepolymer obtained by reacting an isocyanate compound (a) selected from 2,4-tolylene diisocyanate and 2,6-tolylene diisocyanate with polytetramethylene glycol (b) and an aromatic polyamine selected from 3,5-dimethylthiotoluenediamine and0 3,5-iethyltoluenediamine.

4. A shoe press comprising a reinforcing fiber base and said-a polyurethane layer that are integral with each other, wherein:

the polyurethane layer comprises an outer circumferential polyurethane layer, an intermediate polyurethane layer with in which the reinforcing fiber base is embedded, and an inner circumferential polyurethane layer;

the outer circumferential polyurethane layer and the inner circumferential polyurethane layer are respectively disposed opposite sides of the intermediate polyurethane layer;

the outer circumferential polyurethane layer and the inner circumferential polyurethane layer are made of a polyurethane produced by curing a mixed composition of a urethane prepolymer (A) and a curing agent (B);

the urethane prepolymer (A) has a terminal isocyanate group, and is obtained by reacting an isocyanate compound (a) with polytetramethylene glycol (b);

the isocyanate compound (a) comprises 55 to 100 molar % of an isocyanate selected from p-phenylene diisocyanate and 4,4'-methylene-bis(phenyl isocyanate);

the curing agent (B) comprises 85 to 99.9 molar % of 1,4-butanediol and 15 to 0.1 molar % of an aromatic polyamine including the active hydrogen group (H); and the intermediate polyurethane layer is made of a polyurethane produced by curing a mixed composition of a terminal isocyanate group containing urethane prepolymer obtained by reacting an isocyanate compound selected from 2,4-tolylene diisocyanate, 2,6-tolylene diisocyanate and 4,4'-methylene-bis(phenyl isocyanate), with polytetramethylene glycol, and a curing agent selected from 3,5-dimethylthiotoluenediamine and 3,5-diethyltoluenediamine.

5. A shoe press belt, comprising a reinforcing fiber base and a polyurethane layer that are integral with each other, wherein:

the polyurethane layer comprises an outer circumferential polyurethane layer in which the reinforcing fiber base is embedded, and an inner circumferential polyurethane layer;

the outer circumferential polyurethane layer is made of a polyurethane produced by curing a mixed composition of a urethane prepolymer (A) and a curing agent (B);

the urethane prepolymer (A) has a terminal isocyanate group, and is obtained by reacting an isocyanate compound (a) with polytetramethylene glycol (b);

the isocyanate compound (a) comprises 55 to 100 molar % of an isocyanate selected from p-phenylene diisocyanate and 4,4'-methylene-bis(phenyl isocyanate);

the curing agent (B) comprises 85 to 99.9 molar % of 1,4-butanediol and 15 to 0.1 molar % of an aromatic polyamine including the active hydrogen group (H);

the inner circumferential polyurethane layer is made of a polyurethane obtained by curing a composition containing urethane prepolymer with an aromatic polyamine selected from 3,5-dimethylthiotoluenediamine and 3,5-diethyltoluenediamine; and the urethane prepolymer has a terminal isocyanate group, and is obtained by reacting an isocyanate compound selected from 2,4-tolylene diisocyanate, 2,6-tolylene diisocyanate and 4,4'-methylene-bis(phenyl isocyanate), with polytetramethylene glycol.

6. A shoe press belt, comprising a reinforcing fiber base and a polyurethane layer that are integral with each other, wherein:

the polyurethane layer comprises an outer circumferential polyurethane layer, an intermediate polyurethane layer in which the reinforcing fiber base is embedded, and an inner circumferential polyurethane layer;

each of the outer circumferential polyurethane layer, the intermediate polyurethane layer, and the inner circumferential polyurethane layer is made of a polyurethane produced by curing a mixed composition of a urethane prepolymer (A) and a curing agent (B);

the urethane prepolymer (A) has a terminal isocyanate group, and is obtained by reacting an isocyanate compound (a) with polytetramethylene glycol (b);

the isocyanate compound (a) comprises 55 to 100 molar % of an isocyanate selected from p-phenylene diisocyanate and 4,4'-methylene-bis(phenyl isocyanate); and the curing agent (B) comprises 85 to 99.9 molar % of 1,4-butanediol and 15 to 0.1 molar % of an aromatic polyamine including the active hydrogen group (H).

* * * * *

UNITED STATES PATENT AND TRADEMARK OFFICE

CERTIFICATE OF CORRECTION

PATENT NO. : 7,909,965 B2
APPLICATION NO. : 12/600487
DATED : March 22, 2011
INVENTOR(S) : Takao Yazaki et al.

It is certified that error appears in the above-identified patent and that said Letters Patent is hereby corrected as shown below:

Col. 22, Claim 3, line 24, delete "3,5-iethyltoluenediamine" and insert --3,5-diethyltoluenediamine--.

Col. 22, Claim 4, line 25, after "press" insert --belt--.

Signed and Sealed this
Twenty-sixth Day of July, 2011

David J. Kappos

David J. Kappos
*Director of the United States Patent and Trademark Office*